US006569074B2

(12) United States Patent
Bluemle

(10) Patent No.: US 6,569,074 B2
(45) Date of Patent: May 27, 2003

(54) APPARATUS FOR FOLDING FOLDED PRODUCTS SUCH AS MAILING BAGS AND ENVELOPES

(75) Inventor: Martin Bluemle, Horhausen (DE)

(73) Assignee: Winkler + Duennebier AG, Neuwied (DE)

( * ) Notice: Subject to any disclaimer, the term of this patent is extended or adjusted under 35 U.S.C. 154(b) by 0 days.

(21) Appl. No.: 09/858,088

(22) Filed: May 15, 2001

(65) Prior Publication Data

US 2001/0046932 A1 Nov. 29, 2001

(30) Foreign Application Priority Data

May 16, 2000 (DE) ..... 100 23 712

(51) Int. Cl.[7] ..... B31B 1/56

(52) U.S. Cl. ..... 493/245; 271/2; 271/184; 271/185; 271/186

(58) Field of Search ..... 53/284.3, 376.3, 53/377.6, 569; 493/418, 420, 424, 442, 450; 270/58.06; 400/626; 271/2, 184, 185, 186

(56) References Cited

U.S. PATENT DOCUMENTS 3,689,061 A * 9/1972 Nystrand ..... 493/369
3,870,292 A * 3/1975 Bradley ..... 493/353
4,161,091 A * 7/1979 Hartnig ..... 493/216
4,270,909 A * 6/1981 Ireland ..... 493/245
4,612,752 A * 9/1986 Deal ..... 53/377.3
5,048,809 A * 9/1991 Tebbe et al. ..... 270/45
5,072,922 A * 12/1991 Paulson ..... 271/99
5,776,285 A * 7/1998 Blumle ..... 156/256
5,803,632 A * 9/1998 Grossman ..... 400/626

FOREIGN PATENT DOCUMENTS

| | | |
|---|---|---|
| DE | 2014702 | 10/1971 |
| DE | 2218085 | 10/1973 |
| DE | 3702391 | 8/1988 |

* cited by examiner

*Primary Examiner*—Rinaldi I. Rada
*Assistant Examiner*—Brian Nash
(74) *Attorney, Agent, or Firm*—W. F. Fasse; W. G. Fasse

(57) ABSTRACT

In order to fold folded products having sealing flaps with or without mating flaps, such as packaging bags including envelopes with or without self-adhesive glue, the envelopes are moved against a stationary stop and the mating flaps and the sealing flaps are then turned over by suction elements arranged on a mating flap roll and on a sealing flap roll. The mating flap roll, which bears the suction element that turns the mating flaps over, has a radius that is reduced on a part of the roll's circumference that is not equipped with the suction element. The mating flap roll can be locked in such a rotational position, that a folded product not having a mating flap can be moved past this roll to the stationary stop without contacting or virtually without contacting this roll.

12 Claims, 3 Drawing Sheets

APPARATUS FOR FOLDING FOLDED PRODUCTS SUCH AS MAILING BAGS AND ENVELOPES

FIELD OF THE INVENTION

The invention relates to an apparatus for folding folded products with sealing flaps and with or without mating flaps, especially such as packaging bags including envelopes.

BACKGROUND INFORMATION

For many years, apparatus of the type of interest here have been on the market and are used to a great extent in the production of packaging bags including envelopes. In order to fold over the mating flaps and the sealing flaps, the almost completed packaging bags or envelopes are held against a stop and then, during the following opposing movement, are folded over with the aid of suction elements on a mating flap roll or on a sealing flap roll and then transported onward and, for example, deposited with the aid of a paddle wheel.

Furthermore, DE 22 18 085 C2 discloses an apparatus for folding the sealing and mating flaps on envelopes with self-adhesive glue, the flaps being lifted and turned over with the aid of two suction rolls. In addition, a recess is arranged in one suction roll and, adjacent thereto, a suction bar.

The apparatus disclosed by DE 22 18 085 C2 operates considerably more slowly than the folding apparatus on the market and, for this reason, is technically obsolete. Added to this is the fact that the folding apparatus on the market is also suitable for the production of other envelopes which do not have any self-adhesive glue on the sealing flap and instead, have a contact adhesive which becomes effective when moistened, and also no mating flap. For this purpose, however, a suction roll, that is to say the suction roll with the suction element for the mating flap, together with its drive, has to be pivoted completely out of the movement path of the folding product to be completed or the envelope to be completed. The technical outlay associated with this is considerable and is to be avoided.

SUMMARY OF THE INVENTION

It is an object of the invention to avoid the disadvantages of the prior art. In order to achieve this object, the invention proposes that the radius of the mating flap roll, which bears the suction element that turns the mating flaps over, be reduced over a portion of the roll's circumference, and that the mating flap roll can be locked, in such a way that a folding product can be moved past it to the stationary stop even without contact or virtually without contact.

With the aid of the aforementioned features it is possible, on one and the same apparatus, to produce packaging bags including envelopes with a sealing flap and mating flap on the one hand, or only with a sealing flap on the other hand, whereby it is not necessary to convert or reconfigure the apparatus, and only the mating flap roll needs to be stopped in a defined position. The defined position is given when the packaging bag or the envelope can move from the sealing flap roll in the direction of the stationary stop without in so doing significantly touching the mating flap roll. It is therefore possible for various types of envelopes to be completed without difficulty on one and the same machine. The features provided for this purpose according to the invention are not only technically less complicated and also cheaper in terms of production, but they can also be handled more quickly and more simply than the comparable measures according to the prior art.

In addition, the invention provides for at least one suction element to be arranged on the mating flap roll and to project beyond a cylindrical circumference of the mating flap roll. The suction element is no longer integrated in the circumference of the mating flap roll—as in the prior part—and ends at least partly flush with the latter, instead it is elevated like a driver or finger beyond the circumference of the mating flap roll. Nevertheless, during the production of envelopes with self-adhesive glue on both flaps, the suction element is able to grip the mating flap to be turned over by it both securely and reliably, in particular since the envelope is at the same time still stabilized with the aid of the sealing flap roll. In this case, the suction element of the sealing flap roll only releases the sealing flap when the suction element of the mating flap roll has folded over the mating flap completely or virtually completely.

BRIEF DESCRIPTION OF THE DRAWINGS

The invention will be described in more detail below using an exemplary embodiment which is illustrated in the drawings, in which.

Figure 1:
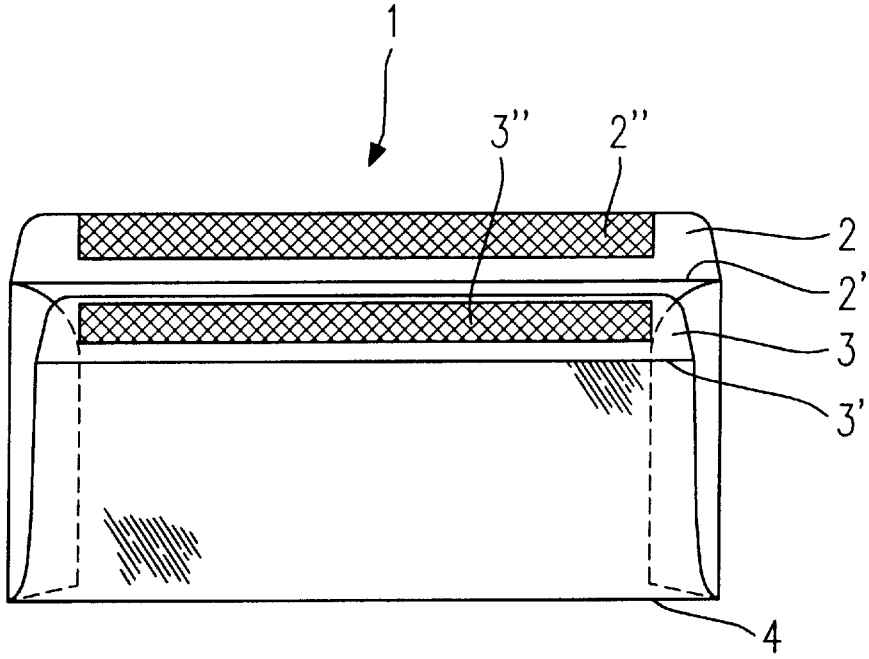
FIG. 1: shows a plan view of the rear of an envelope with self-adhesive glue and with sealing and mating flaps not yet folded over.
Figure 3:
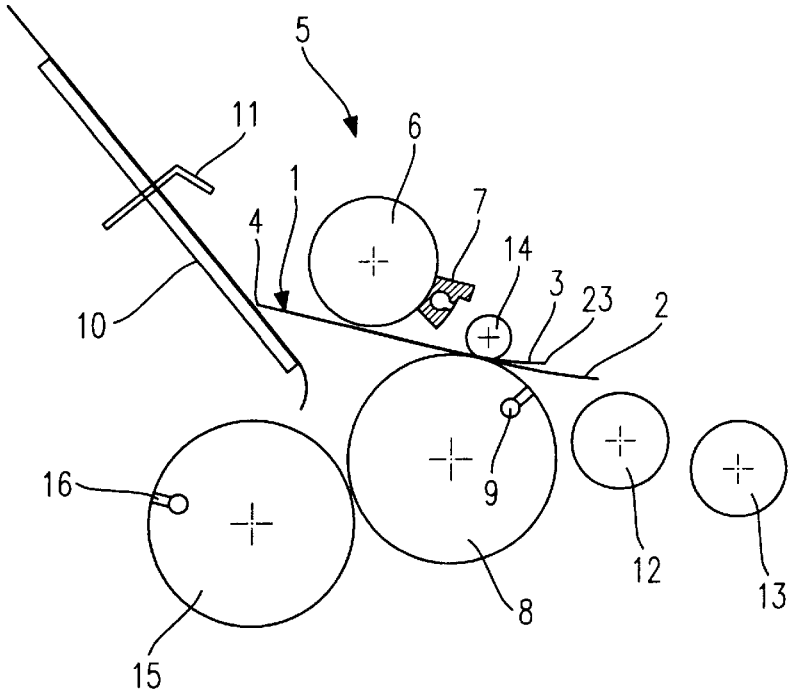
FIG. 3: shows a side view of a basic sketch of the apparatus before the suction elements grip the mating flap and the sealing flap.

A folding product in the shape of an envelope 1 has, according to FIG. 1, a sealing flap 2 which has not yet been folded over, with a crease 2' and with self-adhesive glue 2", and also a mating flap 3 not yet folded over with an associated crease 3' and with self-adhesive glue 3". In this state, the envelopes 1 are supplied individually one after another with the bottom edge 4 leading to an apparatus 5 according to FIG. 3 for folding over the sealing flap 2 and mating flap 3.

DETAILED DESCRIPTION OF A PREFERRED EXAMPLE EMBODIMENT OF THE INVENTION

Figure 2:
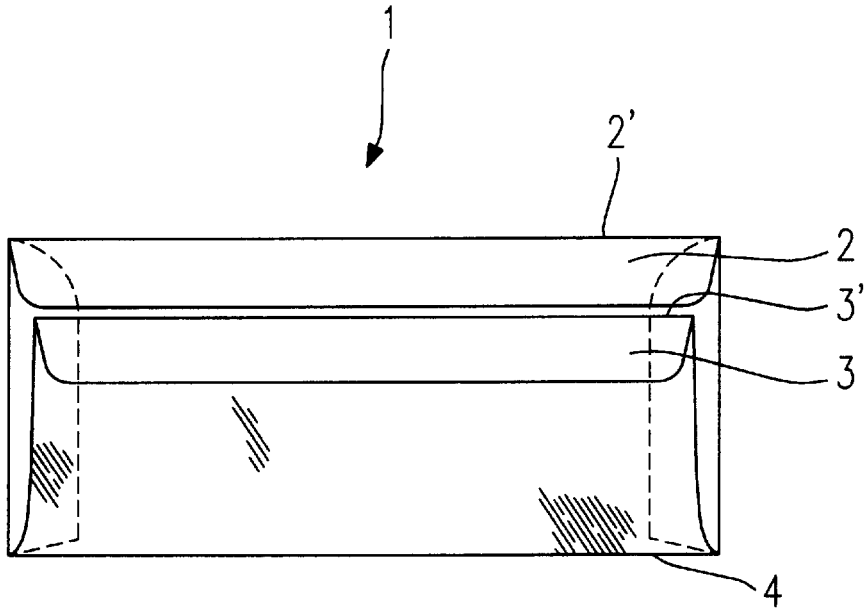
FIG. 2: shows a plan view of the rear of the envelope as in FIG. 1 after the sealing and mating flaps have been folded over.

The apparatus 5 comprises a mating flap roll 6 having a suction element 7 and a sealing flap roll 8 having a suction element 9. Also provided is a holding and guiding element 10 with a stop 11. Further rolls 12 and 13 and 14 and 15 respectively with or without suction elements 16, are used to supply the not yet completed envelope 1 and to transport the completed envelope 1 onward according to FIG. 2 with the sealing flap 2 and mating flap 3 folded over in each case.

Figure 4:
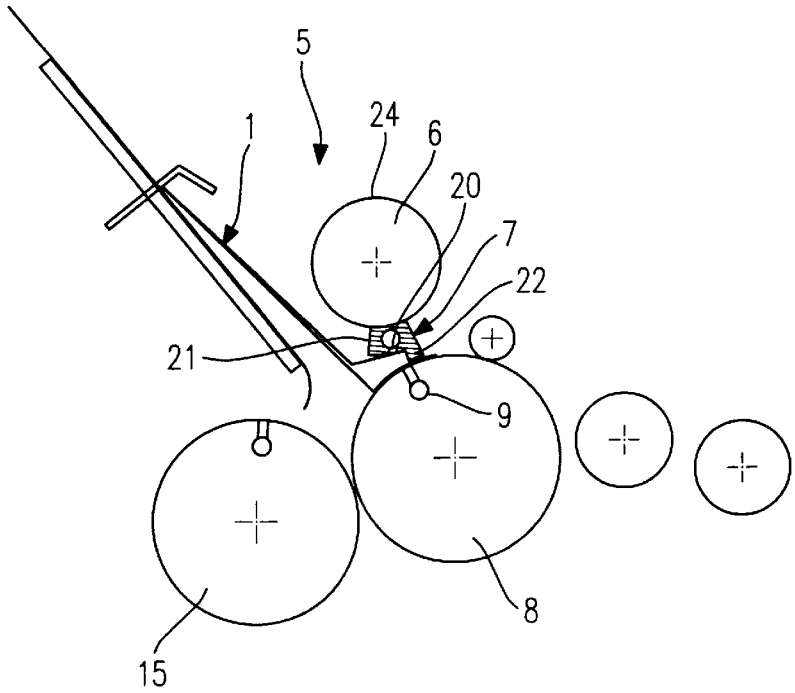
FIG. 4: shows a side view as in FIG. 3 immediately before the suction elements fold the mating flap and the sealing flap over.
Figure 5:
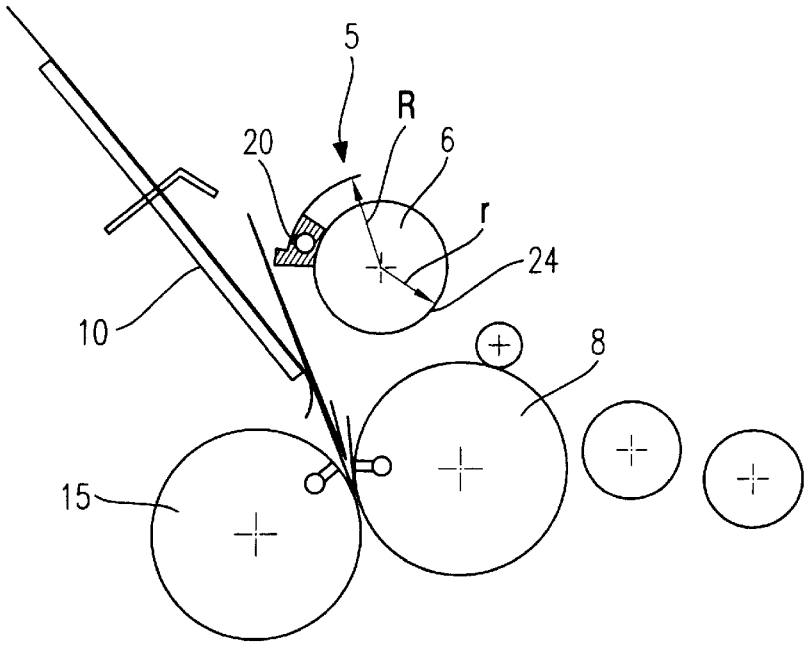
FIG. 5: shows a side view of the apparatus as in FIGS. 3 and 4 with the sealing and mating flaps folded over

The envelope 1 conveyed into the apparatus 5 with the bottom edge 4 leading first encounters the holding and guiding element 10 and is then stopped on the stop 11. Previously, the suction element 7 on the mating flap roll 6 has gripped the mating flap 3 and, in the same way, the suction element 9 on the sealing flap roll 8 has gripped the sealing flap 2 (FIG. 4). The sealing flap roll 8 continues to rotate counterclockwise and pulls the envelope 1 back away from the holding and guiding element 10 once it has reached the position illustrated in FIG. 4, while the mating flap roll 6 continues to rotate in the clockwise direction and releases the mating flap 3 immediately after the latter has reached,the position illustrated in FIG. 4. During the further movement of the envelope 1, the sealing flap 2 and the mating flap 3 are folded over completely, as illustrated in FIG. 5. With its suction element 16, the roll 15 then picks up the completed envelope I and delivers it into a tray. The method sequence outlined takes place in the case of all envelopes 1 in each case having self-adhesive glue and having sealing flaps 2 and mating flaps 3 that have not yet been folded over.

The suction element 7 is a suction bar 21 having suction openings 20 and an approximately segment-shaped cross section. The suction element 7 also includes a stop 22, against which the mating flap 3 rests for a time with its free edge 23 (FIG. 4).

The suction openings 20 in the suction bar 21 are driven under cyclic control with the aid of a vacuum generator, which is known in principle and for this reason is not of specific interest here, and by a suitable, in principle likewise known, vacuum control device.

According to the exemplary embodiment shown in the figures, a suction element 7 is arranged on the mating flap roll 6 and projects beyond a cylindrical circumference 24 of the mating flap roll 6. This applies not only to the stop 22 but, in particular, also to the position of the suction openings 20 in a surface which extends parallel to the axis of the mating flap roll 6, radially outside the cylindrical circumference 26. The radius r which substantially determines the cylindrical circumference 24 of the mating flap roll 6 is therefore at least partly considerably smaller than the radius R on which the suction openings 20 lie (FIG. 5).

Figure 6:
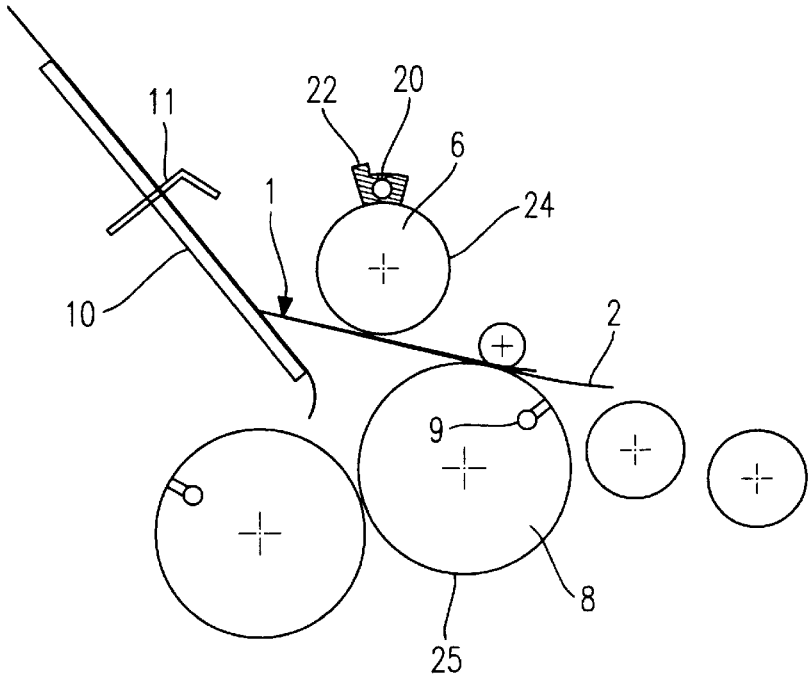
FIG. 6: shows a view as in FIG. 3 with a mating flap roll in a position such that an envelope without self-adhesive glue and without a mating flap can be moved to the stationary stop without contact or virtually without contact.

The diameter reduction for the cylindrical circumference 24 helps to achieve the situation where a folding product or an envelope 1 (according to FIG. 6) can be transported to the holding and guiding element 10 and its stop 11 without contact or virtually without contact with the mating flap roll 6. In this case, too, the sealing flap roll 8 with its suction element 9 grips the sealing flap 2 as in the case described first and places it into the sealing position.

What is claimed is:

1. An apparatus for selectively folding a single first flap on a first product and first and second flaps on a second product, said apparatus comprising:

a first roll that is rotatable in a first rotation direction about a first rotation axis and that is equipped with a first suction element adapted to suction-engage said first flap respectively of said first product and of said second product, wherein a rotation of said first roll in said first rotation direction transports respectively said first product and said second product on a product transport path tangent to said first roll, and said first suction element suction-engaging said first flap respectively of said first product and of said second product folds over said first flap;

a second roll that is selectively rotatable in a second rotation direction opposite said first rotation direction and selectively fixable in a particular fixed rotational position, and that is equipped with a second suction element adapted to suction-engage said second flap of said second product so as to fold over said second flap as said second product is being transported on said product transport path, which extends between said first roll and said second roll; and a stationary product stop arranged at a stop point of said product transport path downstream from said first roll and said second roll, against which stationary product stop a respective leading edge of said first product and of said second product will be physically stopped on said product transport path;

wherein said second roll has a first circumferential portion at which said second suction element is provided and a second circumferential portion that faces said product transport path when said second roll is fixed in said particular fixed rotational position with said second suction element rotationally oriented away from said product transport path; and wherein said first circumferential portion has a first radius relative to said second rotation axis of said second roll, said second circumferential portion has a second radius relative to said second rotation axis of said second roll, and said second radius is smaller than said first radius.

2. The apparatus according to claim 1, wherein said first product is a first mailing package having said single first flap which is a sealing flap, said second product is a second mailing package having said first flap which is a sealing flap and having said second flap which is a mating flap that cooperates with said sealing flap to seal said second mailing package, said first roll is a sealing flap folding roll, and said second roll is a mating flap folding roll.

3. The apparatus according to claim 1, wherein said second radius of said second circumferential portion and a position of said second roll are selected so that said second circumferential portion of said second roll does not contact said first product being transported on said product transport path, with said second roll fixed in said particular fixed rotational position.

4. The apparatus according to claim 1, wherein said second radius of said second circumferential portion and a position of said second roll are selected so that said second circumferential portion of said second roll just barely tangentially contacts said first product being transported on said product transport path, with said second roll fixed in said particular fixed rotational position.

5. The apparatus according to claim 1, wherein said second roll comprises a base roll with a cylindrical circumference, and said second suction element is mounted on said base roll and protrudes radially outwardly beyond said cylindrical circumference.

6. The apparatus according to claim 5, wherein said second suction element comprises a suction bar having suction openings and a segment-shaped cross-section, and further comprises a stop protrusion protruding radially outwardly from said suction bar.

7. The apparatus according to claim 1, wherein said second suction element comprises a suction bar having suction openings and a segment-shaped cross-section, and further comprises a stop protrusion protruding radially outwardly from said suction bar.

8. The apparatus according to claim 1, wherein said second circumferential portion has a cylindrical segment surface with said second radius, and said second suction element has a radially outwardly facing suction surface with said first radius and with suction openings therein.

9. The apparatus according to claim 8, wherein said second suction element further includes a stop protrusion that protrudes adjacent to and radially outwardly beyond said suction surface.

10. The apparatus according to claim 8, wherein said first radius of said suction surface and a position of said second roll are selected so that said suction surface is spaced away from and does not contact said first roll at any rotational position of said second roll.

11. The apparatus according to claim 1, further comprising a third roll that is equipped with a third suction element and that is arranged tangentially adjacent to said first roll with a roll nip therebetween, wherein said third suction element is adapted to suction-engage respectively said first product and said second product, and said third roll is rotatable about a third rotation axis in said second rotation direction opposite said first rotation direction of said first roll to cooperate with said first roll in order to transport respectively said first product and said second product back away from said stationary product stop along a continuation of said product transport path extending from said stationary product stop and outwardly therefrom between said first and third rolls.

12. The apparatus according to claim 11, wherein said second roll and said third roll are arranged relative to said first roll so as to form an angle between a first line intersecting said first rotation axis and said second rotation axis in a cross-section plane and a second line intersecting said first rotation axis and said third rotation axis in said cross-section plane, and wherein said stationary product stop is located relative to said first roll at a location dividing said angle.

* * * * *